US005194707A

United States Patent [19]

Wallach

[11] Patent Number: 5,194,707

[45] Date of Patent: Mar. 16, 1993

[54] INERTIA SWITCH

[75] Inventor: Mark Wallach, Markham, Canada

[73] Assignee: Wallach Manufacturing Ltd., Markham, Canada

[21] Appl. No.: 770,914

[22] Filed: Oct. 4, 1991

[51] Int. Cl.[5] ..... H01H 35/14

[52] U.S. Cl. ..... 200/61.45 R; 200/61.52; 200/DIG. 29

[58] Field of Search ..... 200/61.45 R, 61.53, 200/DIG. 29

[56] References Cited

U.S. PATENT DOCUMENTS

| | | | |
|---|---|---|---|
| 1,274,670 | 8/1918 | Brackett | 200/DIG. 29 |
| 2,892,049 | 6/1959 | Rubinstein | 200/DIG. 29 |
| 2,996,586 | 8/1961 | Shindledecker et al. | 200/61.45 R |
| 3,757,266 | 9/1973 | Newman et al. | 200/DIG. 29 |
| 4,185,180 | 1/1980 | Anderson | 200/61.45 R |
| 4,450,326 | 5/1984 | Ledger | 200/61.45 M |
| 4,467,153 | 8/1984 | Jones et al. | 200/61.45 R |
| 4,628,160 | 12/1986 | Canevari | 200/61.45 R |
| 5,030,955 | 7/1991 | Durst et al. | 200/DIG. 29 |

*Primary Examiner*—J. R. Scott

[57] ABSTRACT

An inertia switch for sensing shock or vibrations imparted to an object to which said switch is secured. The switch comprises a pair of spaced-apart, electrically-conductive contact plates. Each plate has at least one cavity therein. The plates are held in fixed, spaced, parallel relationship to one another with the cavities facing and aligned with each other to constitute at least one opposed pair of cavities. A metal ball is loosely captive between the at least one opposed pair of cavities so that the ball, when in a condition of rest, establishes four conductive contact points, two with each of the plates.

9 Claims, 2 Drawing Sheets

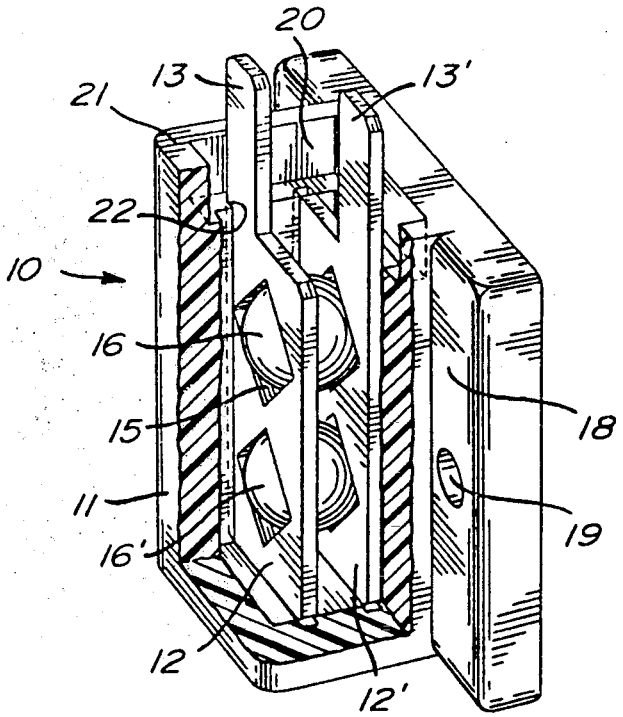
FIG. 1
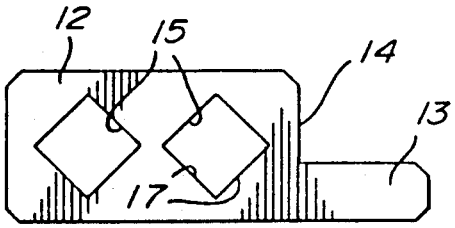
FIG. 2
FIG. 3
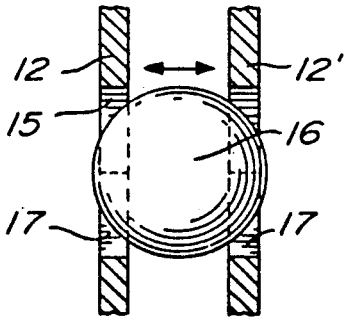
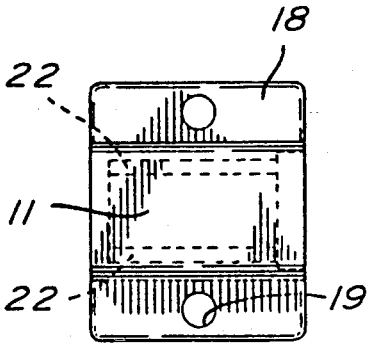
FIG. 4A
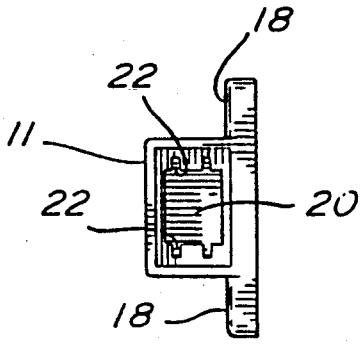
FIG. 4B

INERTIA SWITCH

BACKGROUND OF INVENTION

1. Field of Invention

The present invention relates to an inertia switch for sensing shock or vibrations imparted to an object to which the switch is secured, and wherein the switch consists essentially of a pair of spaced-apart, electrically-conductive contact plates, each having at least one cavity therein in opposed aligned relationship with a metal ball loosely captive between the pair of cavities and in contact therewith to establish an electrical conductive path through the ball, and wherein the ball engages each of the cavities at at least two contact points.

2. Description of Prior Art

Inertia switches having metal balls which are displaceable by shocks or vibrations to effectuate a switch function to inditate a disturbance are known. There are many known types of such switches and some of these utilize magnets or other means to retain the metal ball at a predetermined position. Once the ball is displaced the switch requires mechanical or electrical resetting. A major disadvantage of inertia switches is that many of these must be mounted in a precisely oriented manner in order to operate. Accordingly, such switches have found limited utility. A still further disadvantage of inertia switches which utilize balls is that often the electrical contact between the ball and the contact element is serious affected by the infiltration of dust particles or other foreign matter within the switch casing.

The improved inertia of the present invention is an improvement over the shock and vibration sensitive switch as disclosed in U.S. Pat. No. 4,467,153. In that patent there is described a switch construction in which two E-shaped electrodes are mounted in a frame member in planar alignment, one on opposite sides, and define dual cavities between the arms of the electrode. Two cylindrical conductive members are retained loosely captive between the two cavities formed between the E-shaped electrodes. The circumference of the cylindrical element is such as to contact two arms of the electrodes to establish a contact thereacross. Accordingly four contacts are established by the two conductive cylinders and the electrodes. A major disadvantage of this switch construction is that it can only operate effectively when positioned vertically along its longitudinal axis. Therefore, it can operate either right side up or up side down. If the housing is mounted at a slight angle from its axis, its sensitivity is minimized and may produce false switch closures and alarms. U.S. Pat. No. 4,185,180 also discloses an inertia switch which utilizes two plates having a through bore therein with an ondulated rim and a conductive rod element is captive between the aligned cavities or through bores. Such switch also has a disadvantage of having to be mounted at a precise orientation in order to work. This type of unit has a shorter period of discontinuity when vibrated.

SUMMARY OF INVENTION

It is a feature of the present invention to provide an inertia switch for sensing shock or vibrations imparted to an object and wherein the switch can be oriented to any angle along a 360° arc.

Another feature of the present invention is to provide an inertia switch for sensing shock or vibrations imparted to an object, and wherein the switch includes a pair of spaced-apart, electrically-conductive contact plates having aligned facial cavities and retaining therebetween one or two metal balls providing four or eight conductive contact points thereby providing better consistency and less chance of false or unwarranted alarms as compared with the prior art switches hereinabove described.

Another feature of the present invention is to provide an inertia switch for sensing shock or vibrations imparted to an object, and wherein the switch may be used in a burglar alarm system for detecting abnormalities of vibration in machines, or in many other applications where it is necessary to detect a shock or abnormal vibrations such as with a washing machine, an automated milling or lathe machine, etc.

The use of vibration sensors has long been established as an effective way to monitor shocks and vibrations. In order for the switch to be effective, great care must be taken to ensure that the internal switching components of the switch are free from moisture or dust particles that can settle between the contact points thereby rendering the switch ineffective. It is therefore another feature of the present invention to provide an inertia switch wherein the switch contacts and the metal ball operate in a dust and moisture-free environment by locating same in a sealed housing.

According to the above features, from a broad aspect, the present invention provides an inertia switch for sensing shock or vibrations imparted to an objected. The switch comprises a pair of spaced-apart, electrically-conductive contact plates. Each plate has at least one cavity therein. The plates are held in fixed, spaced, parallel facial relationship to one another with the cavities facing and aligned with each other to constitute at least one opposed pair of cavities. A metal ball is loosely captive between the at least one opposed pair of cavities so that the ball, when in a condition of rest, establishes four conductive contact points, two with each of the plates.

BRIEF DESCRIPTION OF DRAWINGS

A preferred embodiment of the present invention will now be described with reference to the accompanying drawings, in which:

FIG. 1 is a fragmented perspective view of the inertia switch of the present invention;

FIG. 2 is a plan view of the construction of the contact plates;

FIG. 3 is a fragmented sectional side view showing adjacent cavities in the contact plate and the loosely retained contact ball;

FIG. 4A is a top view of the switch housing;

FIG. 4B is an end view of the switch housing as seen from the open side thereof;

DESCRIPTION OF PREFERRED EMBODIMENTS

Figure 5A:
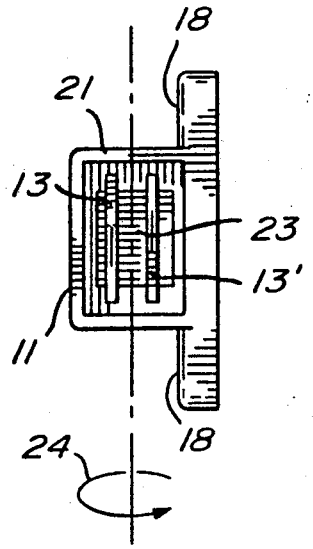
FIGS. 5A, 5B and 5C are illustrations showing the different orientations of the switch housing.

Referring to the drawings, and more particularly to FIGS. 1 to 4B, there will be described the construction and operation of the inertia switch 10 of the present invention. As shown in FIG. 1, the inertia swith 10 is comprised of a housing 11 in which is retained a pair of spaced-apart, electrically-conductive contact plates 12 and 12'. The construction of these plates is better illustrated in FIG. 2, and as herein shown, they are flat rectangular plates each having an integral contact arm 13 and 13' respectively extending from a top end edge 14 thereof. A pair of diamond-shaped cavities 15 are formed in each of the plates. These cavities are herein shown as being through bores of rectangular or diamond-shaped outline. However, it is within the ambit of the present invention to cover other shapes of cavities to achieve the desired result of the present invention as described herein. It is also within the ambit of the present invention to provide a single cavity in each of the plates to constitute a single switching element, but in order to achieve more sensitivity, it is desirable to have two or more pairs of these cavities, each having a contact metal ball 16 loosely captive by each pair.

The metal ball 16 is retained loosely captive between each, opposed pair of cavities 15, as shown in FIGS. 1 and 3, constitutes an electrically-conductive path between the pairs of contact plates 12 and 12'. With the diamond-shaped cavities, there is established two contact points between the balls 16 and a pair of adjacent walls 17 of the cavities 15, see FIG. 2. Accordingly, as shown in FIG. 3 the ball 16 has two contact points with the adjacent walls 17 of the plate 12 and two further contact points with the adjacent walls 17 of the plate 12. The ball 16' similarly has four contact points. Accordingly, there is a total of eight contact points formed between the two contact plates and the two balls. This provides for a switch in which the occurance of false switch closures are very unlikely due to the many contact points. With reference to FIG. 3, it can be seen that, as the ball 16 is displaced to the right or left due to an impact force, it will be displaced away from its contact with the opposed walls 17 of the cavity of one of the plates 12 or 12' and cause an open circuit condition between the plates, and with the switch mounted in any of the positions, as shown and described with reference to FIGS. 5A to 5C.

The contact plates and balls are retained within a switch housing 11 which is comprised of a rectangular casing having flanges 18 provided with screw receiving holes therein for mounting the housing at a desired position on an object to be monitored. The casing has a cavity 20 with aligned slots 22 on opposed sides thereof to precisely locate the contact plates in facial parallel aligned relationship. When the plates are disposed within the cavity 20 the contact arms 13 protrude from the housing end wall 21. A cover 23 is then pressfitted or otherwise welded by ultrasound, etc. in the top opening of the cavity so that only the contact arms protrude therefrom with the remaining part of the plates and balls being substantially hermetically sealed to prevent the ingress of dust particles or moisture. It can be appreciated that the switch of the present invention is easy to assemble in such a housing structure while achieving precision in the disposition of the contact plates and the balls. As can be seen, the diamond-shaped cavities 15 have their apexes disposed transverse to the opposed end and side edges of the plates 12, as is clearly shown in FIG. 2. It is still further pointed out that the contact plates, or at least the area surrounding the cavities 15 and the balls, may be gold-plated to provide corrosion-resistant contact paths.

Figure 5B:
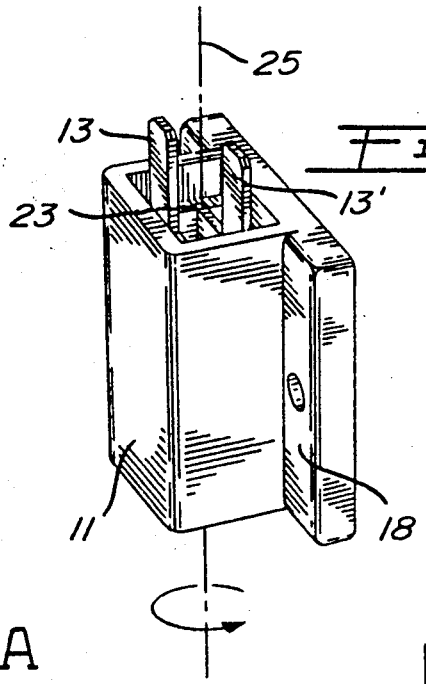
Figure 5C:
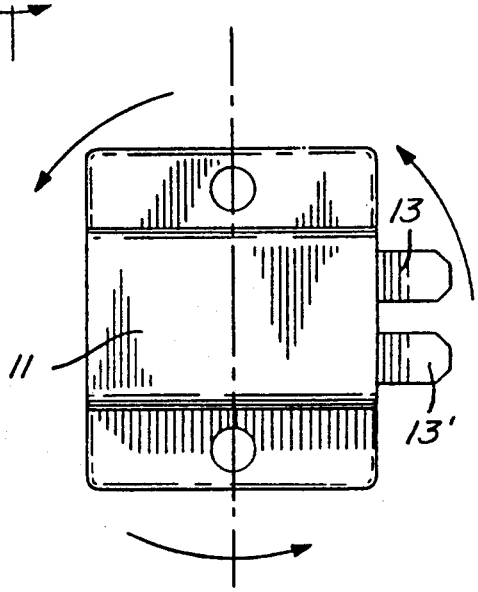

An important advantage of the construction of this inertia switch is its sensitivity making it responsive to both high and low level shocks thus making it appropriate for numerous applications. With particular reference to FIGS. 5A to 5C, it can be seen that the switch can be mounted sideways along the horizontal axis, as shown in FIG. 5A, and positioned at any angle in the horizontal plane, as shown by arrow 24. The switch can also be rotated on its longitudinal axis 25, as shown in FIG. 5B, or placed at any angle within a 360°-circumference of its transverse axis along a vertical plane, as shown in FIG. 5C. Accordingly, the switch construction of the present invention permits its mounting and effective functioning at numerous positions thereby further increasing its applications. For example, the switch could be used as a built-in safety or override switch which would detect abnormalities of vibration in an operating machine to signal a control unit which can initiate partial or total shut down of the machine.

The switch of the present invention is a normally closed inertia switch particularly, but not exclusively, developed for use in a burglar alarm system, with the switch housing at various locations, such as on windows, ceilings, floors and fences, just to name a few applications, to detect vibrations imparted by an unwanted intruder. The switch can also be mounted on a washing machine, or any industrial machine, such as a milling or lathe machine, to initiate an alarm signal when the machine or the appliance exceeds a predetermined amplitude of oscillation. The switch would initiate a signal to cause a shut down.

Figure 6A:
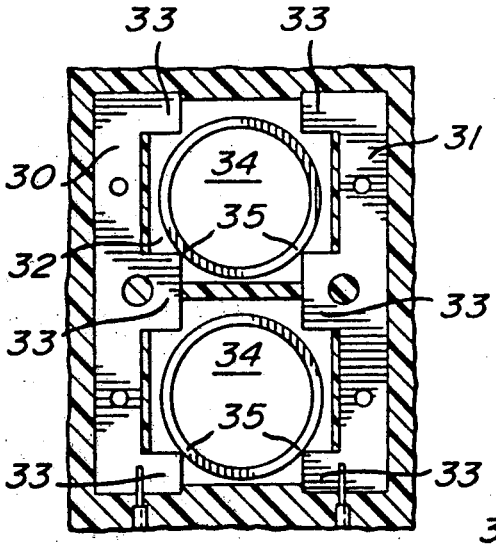
FIG. 6A (PRIOR ART)
FIGS. 6A and 6B are fragmented plan views of a prior art inertia swtich.
Figure 6B:
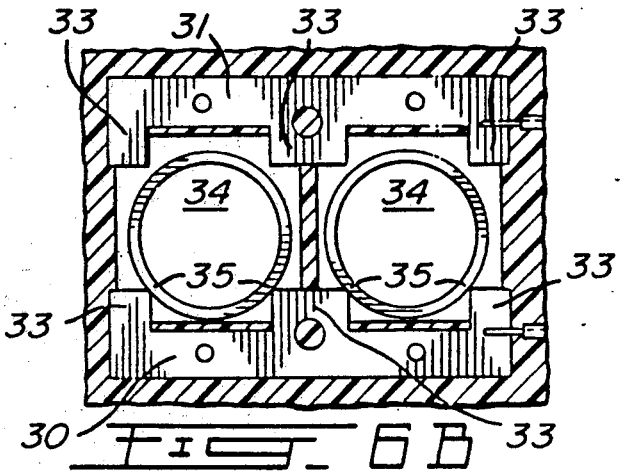
FIG. 6B (PRIOR ART)

FIGS. 6A and 6B illustrate one of the prior art switches as previously described wherein two E-shaped electrodes 30 and 31 are mounted facing one another in spaced planar relationship to align the cavities 32 formed between the ends of the arms 33. A pair of metal discs 34 are held between an opposed pair of arms to establish a contact point with each of said arms, as illustrated by reference numeral 35. Accordingly, four contact points would be established between the pair of discs and opposed electrodes 30 and 31. A disadvantage of such switch, as previously mentioned, is that having only four contact points it is susceptible to fault and error.

Also, and more limiting is the fact that this switch cannot operate when disposed at an acute angle or on its side, as shown in FIG. 6B. When disposed on its side only one of the electrodes would be contacted by the disc. Therefore, this type of switch housing has limited applications, and was designed to be oriented specifically along its vertical axis, as shown in FIG. 6A.

It is within the ambit of the present invention to cover any obvious modifications of the preferred embodiment described herein, provided such modifications fall within the scope of the appended claims.

I claim:

1. A normally closed inertia switch for sensing shock or vibrations imparted to an object, said switch comprising housing means for retaining a pair of spaced-apart electrically-conductive contact plates, each plate having at least one cavity therein, said plates being held in fixed spaced parallel facial relationship to one another with said cavities facing and aligned with each other to constitute at least one opposed pair of cavities, a metal ball loosely captive between said at least one opposed pair of cavities, said ball when in a condition of rest establishing four conductive contact points, two with each of said plates to form a closed circuit between said plates, said cavities being dimensioned to define a space beyond said contact points to permit said ball to be displaced in one of said cavities sufficiently to move out of contact with the other of said cavities, and attachment means to secure said inertia switch with said plates having there planes upright and positioned at any angle along a 360° vertical plane.

2. An inertia switch as claimed in claim 1 wherein there are two cavities in each of said pair contact plates to form two pairs of opposed cavities, a ball being held captive in each of said pair of opposed cavities, each ball having four electrical contact points and engaging each of said plates for a total of eight contact points.

3. An inertia switch as claimed in claim 2 wherein said cavities are through bores formed in said flat electrically-conductive contact plates.

4. An inertia switch as claimed in claim 3 wherein said cavities are rectangular cavities.

5. An inertia switch as claimed in claim 3 wherein said cavities are diamond-shaped cavities.

6. An inertia switch as claimed in claim 5 wherein said contact plates are rectangular plates formed with an integral contact arm extending from an end edge thereof, said diamond-shaped cavities having their opposed apexes aligned transverse with opposed end and side edges of said plates.

7. An inertia switch as claimed in claim 3 wherein integral contact arm extending from an end wall thereof, said plates being retained captive in alignment slots of a switch housing constituting said housing means with said, contact arms of said plates extending out of said switch housing.

8. An inertia switch as claimed in claim 7 wherein said housing is a sealed housing preventing the ingress of dust particles and moisture.

9. An inertia switch as claimed in claim 7 wherein said contact plates and said balls are gold plated plates and balls to provide corrosion-resistant contact paths.

* * * * *